United States Patent [19]

Malm

[11] 4,427,232

[45] Jan. 24, 1984

[54] REVERSIBLE CHAIR-DESK CONSTRUCTION

[76] Inventor: Richard K. Malm, Rte. 2, Maple Park, Ill. 60151

[21] Appl. No.: 238,759

[22] Filed: Feb. 27, 1981

[51] Int. Cl.[3] ..... A47B 83/02

[52] U.S. Cl. ..... 297/161; 297/411

[58] Field of Search ..... 297/161, 160, 162, 94, 297/411, 353, 94

[56] References Cited

U.S. PATENT DOCUMENTS

| | | | |
|---|---|---|---|
| 188,592 | 3/1877 | Coburn | 297/353 X |
| 438,610 | 10/1890 | Dennett | 297/94 X |
| 2,471,183 | 5/1949 | Adams | 297/173 X |
| 3,156,498 | 11/1964 | Blodee | 297/162 |
| 3,371,956 | 3/1968 | Jordan et al. | 297/162 |
| 3,408,104 | 10/1968 | Raynes | 297/162 |
| 4,025,112 | 5/1977 | Hale | 297/411 |

*Primary Examiner*—Francis K. Zugel

*Attorney, Agent, or Firm*—Wood, Dalton, Phillips, Mason & Rowe

[57] ABSTRACT

A reversible chair-desk construction for use by left and right handed persons with equal facility including a chair having an upright back. A generally L-shaped tablet arm terminates at one end in an enlarged tablet having two opposed sides, each defining a writing surface and the opposite end of the arm is pivoted to the back of the chair generally medially of the center thereof to define a substantially horizontal pivot axis. The tablet may thus be pivoted between writing positions on either the right hand or the left hand side of the chair to allow the chair to be converted very simply to the writing style of the person to occupy the same.

8 Claims, 4 Drawing Figures

REVERSIBLE CHAIR-DESK CONSTRUCTION

FIELD OF THE INVENTION

This invention relates to combination chair-desk constructions, and more particularly, to a reversible chair-desk construction which may be used by left or right handed persons with equal facility.

BACKGROUND OF THE INVENTION

Chair-desk constructions have long been used by a variety of institutions such as schools, churches, corporations for training sessions and the like since they offer the obvious advantage of providing a seating surface to be occupied by a person along with a writing surface associated therewith on which notes or the like may be taken. Heretofore, such chair-desk combinations have been universally designed for right handed persons apparently due to the fact that the percentage of the population that is right handed greatly exceeds the percentage of the population that is left handed so it is uneconomical for business entities manufacturing such chair-desks to manufacture constructions specifically designed for left handed persons.

As a consequence, left handed persons using conventional chair-desks are handicapped in writing with the same since, typically, no support for the writing arm of such person is provided.

SUMMARY OF THE INVENTION

It is the principal object of the invention to provide a new and improved, reversible chair-desk construction that can be used with equal facility by either left or right handed persons. More specifically, it is an object of the invention to provide such a construction that may be economically manufactured and which does not require separate tooling, one set of such tooling for chairs for use by right handed persons and another set of tooling for chairs for use by left handed persons.

An exemplary embodiment of the invention achieves the foregoing object in a construction including means defining a seating surface with a generally horizontal seat and with a vertically extending back at the rear of the seat. The construction includes a generally planar tablet having two opposed sides, each defining a writing surface. Means connect the tablet to the back of the seating surface for at least pivotal movement about a substantially horizontal axis generally medially of the back and substantially transverse thereto so that the tablet may be swung to either side of the seat. Means are provided for holding the tablet in a generally horizontal position on either of the sides of the seat so that the tablet may be moved to either of the sides for use of one or the other of the writing surface by a right or left handed person as appropriate.

In a highly preferred embodiment, the tablet is defined by an enlargement of an L-shaped arm at one end thereof. The opposite end of the L-shaped arm is pivoted by a pivot on the rear of the back of the chair as mentioned previously.

A highly preferred embodiment contemplates that the back of the chair, extending above the pivot, is constructed such as not to interfere with swinging movement of the tablet or arm from one side to the other.

Other objects and advantages will become apparent from the following specification taken in connection with the accompanying drawings.

DESCRIPTION OF THE PREFERRED EMBODIMENT

Figure 1:
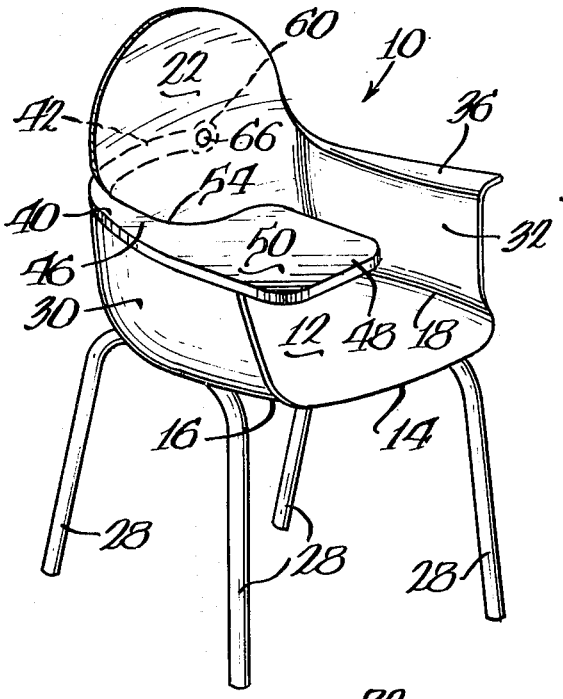
FIG. 1 is a perspective view of a reversible chair-desk made according to the invention with the parts thereof configured for use by a right handed person.
Figure 2:
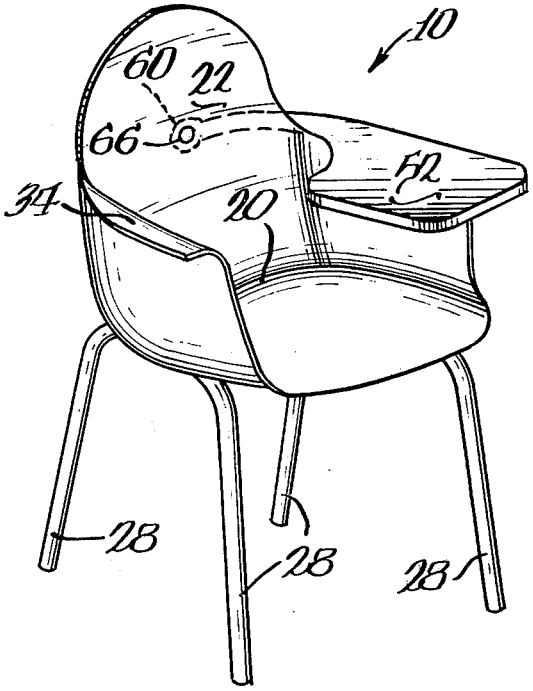
FIG. 2 is a view similar to FIG. 1 but with the chair components oriented for use by a left handed person.

An exemplary embodiment of a reversible chair-desk construction made according to the invention is illustrated in the drawings and with reference to FIGS. 1 and 2 is seen to include means defining a chair or seating surface, generally designated 10, including a generally horizontal seat 12 having a forward edge 14, a right hand edge 16, a left hand edge 18, a rear edge 20 and an upstanding back 22 located at the rear edge 20.

A plurality of tubular legs 28 are secured in any conventional manner to the undersurface of the seat 12 to support the same in an elevated position above an underlying floor or the like.

In a preferred embodiment, the seat 12 and back 22 are integrally formed of, for example, reinforced plastic, as by molding and when such is the case, the right and left edges 16 and 18 may include upward continuations 30 and 32 respectively which, at their upper extents, terminate in outwardly directed, horizontal, arms 34 and 36 on the right and left hand sides of the chair respectively.

The construction includes a generally L-shaped arm 40 having a rear length 42 behind the rear surface 44 of the back 22 and a forwardly extending length 46 terminating in an enlarged tablet 48. The tablet 48 is generally planar and includes opposed writing surfaces 50 (FIG. 1) and 52 (FIG. 2), respectively. As will be noted, the forward length 46 of the arm 40 overlies one or the other of the arms 34 and 36 dependent upon where the tablet 48 is positioned and the arrangement is such that the tablet 48 is directed inwardly toward the center line of the chair considered from front to rear to thereby provide a cut-out 54 for the torso of a person occupying the chair.

Figure 4:
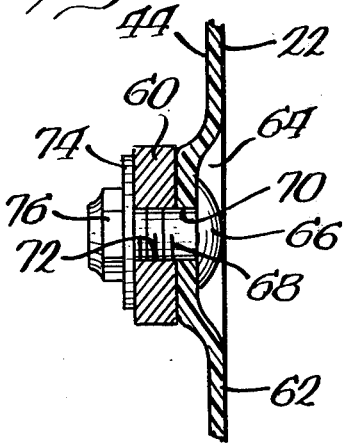
FIG. 4 is an enlarged, fragmentary sectional view taken approximately along the line 4—4 of FIG. 3.

The end of the arm 40 opposite the tablet 48, that is, the free end of the rear length 42 shown at 60, is pivoted to the back 22 of the chair, and specifically, on the rear surface 44 thereof. As best seen in FIG. 4, the forward surface 62 of the back 22 of the chair is provided with a small recess 64 which receives the head 66 of the bolt 68 or the like. The bolt 68 extends through an opening 70 in the back 22 of the chair and through an aperture 72 in the end of the arm 40. The arm 40 is captured on the bolt 68 by means of a washer 74 and a nut 76. Thus, the bolt 68 defines a horizontal pivot axis for the arm 40, which pivot axis is disposed on the center line of the chiar from front to back, that is, medially of the chair. The pivot axis is also transverse to the back 22 and generally will be located at about a vertical position on the back 22 equal to the height of the arms 34 and 36 so that the tablet will be in a substantially horizontal position when it is resting on either one of the arms 34 or 36.

Figure 3:
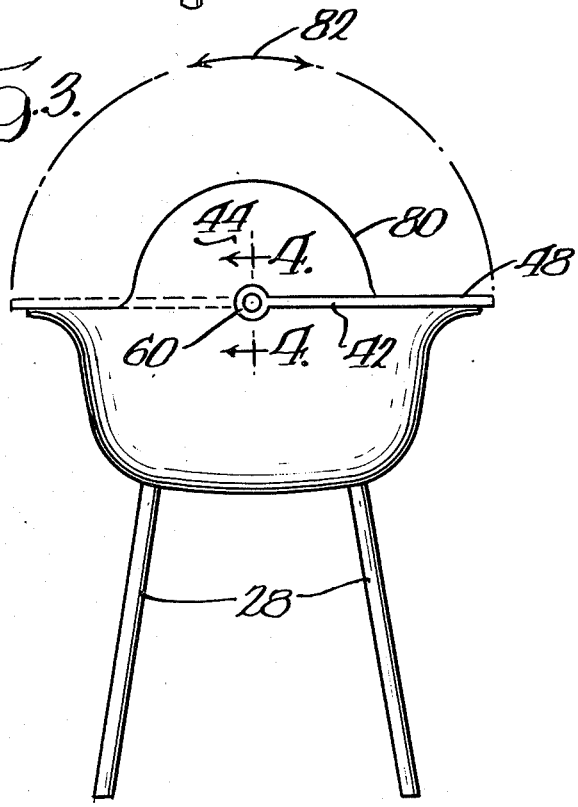
FIG. 3 is a rear elevation of the chair.

As seen in FIG. 3, the upper edge of the back 22 above the bolt 68 is arcuate as shown at 80. The radius of the arcuate edge 80 is selected to be just less than the length of the rear length 42 of the arm 40 so as to allow the tablet 48 to be pivoted bidirectionally in the direction of an arrow 82 as shown in FIG. 3 to rest on either of the arms 34 and 36.

From the foregoing, it will be appreciated that the tablet 48 can be moved to either side of the seat 12. When in the position shown in FIG. 1, a right handed person may use the writing surface 50 while when the tablet is in the position illustrated in FIG. 2, a left handed person may use the writing surface 52. At the same time, the non-writing arm of either such person may utilize the arm 34 or 36 of the chair not covered by the tablet 48.

In some instances, it may be desirable to dispense with the arms 34 and 36 in which case, some suitable stop structure may be utilized to support the tablet 48 in either of the positions shown in FIGS. 1 and 2 since the arms 34 and 36 in the illustrated embodiment perform this function.

It should also be observed that in some instances, a more complicated structure than that shown in FIG. 4 may be employed in connecting the tablet to the chair. For example, another pivot axis transverse to that shown might be provided to allow the tablet 48 to be swung outwardly from the chair to clear the corresponding arm 34 and 36 so as to be lowered to rest against the legs 28 when there is no need for use of the tablet.

It will therefore be appreciated that a reversible chair-desk made according to the invention is simple in construction and may be utilized with equal facility by either right or left handed persons. Only one set of tooling is required to manufacture the chair that can be used by either right or left handed persons and it will further be appreciated that institutions purchasing such chairs need not concern themselves with the relative percentages of right handed and left handed persons who are to use such chair-desk constructions since the construction is readily adaptable to either simply by pivoting the tablet 48 from one side to the other of the chair.

I claim:

1. A reversible chair-desk construction for use by left and right handed persons with equal facility comprising:

a chair having a generally horizontal seat having a front, a rear, and right and left sides, with a vertically extending back at the rear of the seat and means for supporting the seat in an elevated position above an underlying floor or the like;

a generally L-shaped tablet arm terminating at one end in an enlarged tablet having two opposed sides each defining a writing surface;

means pivotally interconnecting the other end of said arm to the back of said chair generally medially of the center thereof to define a substantially horizontal pivot axis for said arm so that said arm may by swung to either the left or right side of said seat; and means for supporting said arm in a generally horizontal position on either said left or right side of said seat;

whereby said arm may be selectively disposed to either side of said chair for use of one or the other of said writing surfaces by a right or left handed person as appropriate.

2. The reversible chair-desk of claim 1 wherein said back extends above said pivotal interconnecting means an amount insufficient to interfere with swinging movement of said arm.

3. The reversible chair-desk of claim 1 wherein said supporting means comprising chair arms extending generally horizontally along and above said seat, each chair arm adapted to alternatingly supportingly engage a corresponding side of said tablet arm or the arm of an occupant of the chair-desk.

4. A reversible chair-desk construction for use by left or right handed persons with equal facility comrising:

means defining a seating surface with a generally horizontal seat and with a vertically extending back at the rear of the seat;

a generally planar tablet having two opposed sides, each defining a writing surface;

means connecting said tablet to said back for at least pivotal movement about a substantially horizontal axis generally medially of said back and substantially transverse thereto so that said tablet may be swung to either side of said seat; and means for holding said tablet in a generally horizontal position on either of said sides of said seat;

whereby said tablet may be moved to either of said sides for use of one or the other of said writing surfaces by a right or left handed person as appropriate.

5. The chair-desk of claim 4 wherein said tablet is defined by an enlargement of an arm and on an end thereof and is generally directed from said arm toward said connecting means so as to extend inwardly from a side of said seat toward the center thereof.

6. The chair-desk of claim 5 wherein said back has a forward surface adapted to face a person occupying said seat and a rear surface, and said connecting means is located on said rear surface.

7. The chair-desk of claim 6 wherein said connecting means comprises a horizontally disposed pivot and said arm comprises an L-shaped arm having one portion extending along one or the other of the sides of said seat and another portion adjacent said rear surface, said back having an arcuate top above said pivot with a radius less than the length of said another portion of said arm.

8. The chair-desk of claim 4 wherein said connecting means solely defines said substantially horizontal axis.

* * * * *